United States Patent [19]

Lloyd

[11] 4,247,391

[45] Jan. 27, 1981

[54] FROTH FLOTATION CELL AND METHOD OF OPERATION

[76] Inventor: Philip J. D. Lloyd, 5 Erlswold Way, Saxonwold, Johannesburg, South Africa

[21] Appl. No.: 19,782

[22] Filed: Mar. 9, 1979

[51] Int. Cl.[3] ..... B03D 1/02; B03D 1/16

[52] U.S. Cl. ..... 209/164; 209/168; 210/221.1

[58] Field of Search ..... 209/164, 165, 168–170; 210/221 R, 221 M; 261/93, 123

[56] References Cited

U.S. PATENT DOCUMENTS

| | | | |
|---|---|---|---|
| 1,155,816 | 10/1915 | Higgins | 209/169 |
| 1,326,453 | 12/1919 | Jones | 209/168 |
| 2,258,807 | 10/1941 | Hoag | 209/169 X |
| 2,370,350 | 2/1945 | Kamp | 210/221 R X |
| 2,433,592 | 12/1947 | Booth | 261/93 |
| 2,687,213 | 8/1954 | MacLeod | 209/168 X |
| 3,326,373 | 6/1967 | Lang | 209/164 X |
| 3,701,421 | 10/1972 | Maxwell | 209/168 X |

FOREIGN PATENT DOCUMENTS

| | | | |
|---|---|---|---|
| 505993 | 5/1928 | Fed. Rep. of Germany | 261/93 |
| 990511 | 6/1951 | France | 209/169 |
| 174379 | 1/1923 | United Kingdom | 209/169 |
| 837373 | 9/1958 | United Kingdom | 209/169 |

*Primary Examiner*—Robert Halper

*Attorney, Agent, or Firm*—Young & Thompson

[57] ABSTRACT

Coarse particles of up to 3 mm are floated in a cylindrical froth flotation cell in which the agitation impeller has a cover preventing fluid from being drawn in above. Air is supplied from a ring around the periphery of the cell and situated above the cover. Baffles project radially inwardly up to a short distance from the top. Froth is allowed to overflow around the periphery of the cell. The opposed inlet and outlet are disposed respectively below the level and at the level of the impeller. The arrangement is such that the liquid below the layer of froth is substantially quiescent.

5 Claims, 1 Drawing Figure

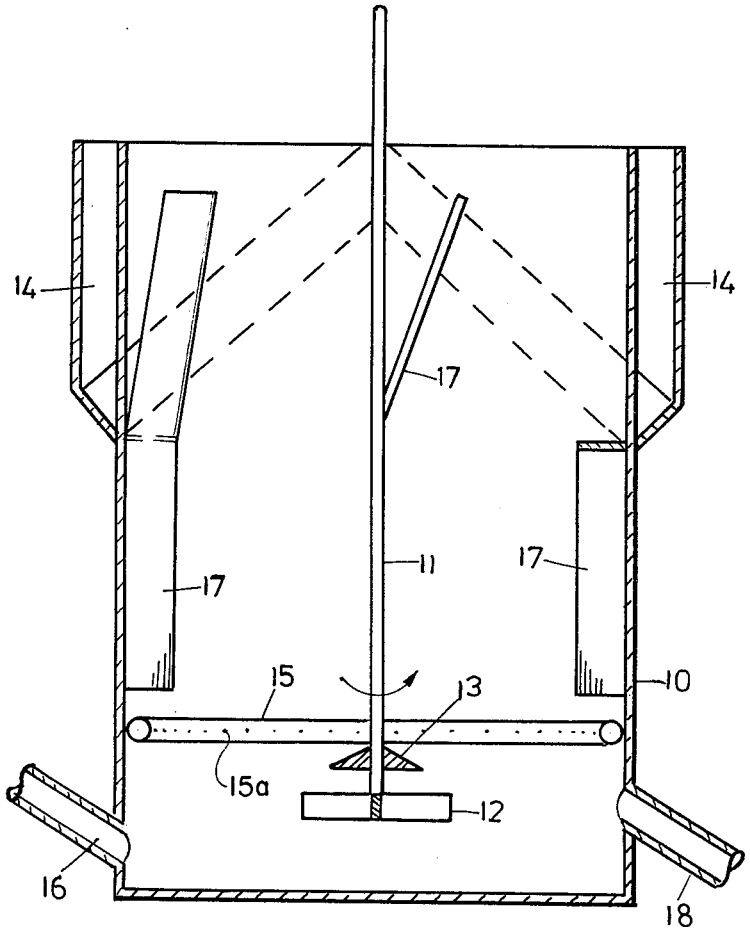
14
14
17
17
17
11
15
13
10
15a
12
16
18

FROTH FLOTATION CELL AND METHOD OF OPERATION

BACKGROUND OF THE INVENTION

This invention relates to a froth flotation cell.

The present invention arose from the requirement of having to separate mineral particles as large as 3 mm by means of froth flotation. Flotation from 3 mm feeds is unusual. In fact flotation feeds seldom exceed 250 microns for metal ores.

SUMMARY OF THE INVENTION

According to the invention a method of recovering coarse particles by froth flotation comprises agitating a conditioned pulp, to which a suitable frother and collector have been added, for turbulent vertical flow, injecting air bubbles into the path of pulp flow in such a way that the only size reduction of the bubbles is due to shear by the pulp, baffling the pulp flow to ensure a quiescent interface between pulp and froth, and collecting the froth from the interface.

The method also includes the steps of introducing pulp to and withdrawing the pulp from the system in a zone of relative pulp agitation.

According to the invention a flotation cell comprises a tank, a driven impeller at a low level in the tank, a cover above the impeller minimizing the entry of fluid from above, and a series of injection points for compressed air around the axis of the tank and above the level of the cover.

Further according to the invention the tank is round cylindrical and overflow of froth is around the entire perimeter of the top of the tank. The invention also provides that the tank has a series of radial axially extending baffles projecting inwardly from the periphery of the tank.

Furthermore the invention provides that pulp be fed into the tank below the stagnation zone of the radial flow from the impeller and that it be withdrawn from the tank in that zone.

DESCRIPTION OF THE DRAWING

It is a section through a froth flotation cell according to the invention.

DESCRIPTION OF A PREFERRED EMBODIMENT

The illustrated cell has a round cylindrical tank 10 in the bottom of which there is a driven impeller 12 rotated by means of a shaft 11. The impeller 12 has four radial vanes and is of standard design. However, above the impeller 12 there is a cover 13 which reduces the entry of air into the impeller 12 from above.

The tank 10 has an overflow launder 14 around its entire top perimeter for collecting froth.

At a level above the cover 13 there is a ring main 15 for injecting compressed air into the tank 10.

An inlet pipe 16 leads to a level below the impeller 12 and an outlet 18 leads from the same level as the impeller 12. Note that the outlet 18 is from the annular stagnation zone of the radial flow from the impeller 12 while the inlet 16 leads to a level below that zone.

A series of baffles 17 project radially inwardly from the wall of the tank 10. The axial extent and the radially inward extent of the baffles 17 require adjustment for various circumstances to ensure that at the top of the tank there is a quiescent pulp-froth interface. It has been found beneficial to have the upper parts of the baffles 17 inclined to the vertical. The angle of inclination may be between 10° and 45°. The direction of inclination is so chosen that, when viewed from above, the inclined sections of the baffles spiral downwardly in the same direction as the direction of rotation of the impeller.

Air is injected from the ring main 15 where the turbulence created by the radial flow from the impeller hitting the wall of the tank 10 provides some shear to reduce the size of the air bubbles and the rotational flow created by the impeller helps to carry the air bubbles radially inwards towards the centre of the tank so that they are reasonably well distributed. Since the air enters the cell through the ring main 15 which is situated above the cover 13, and since the movement of air is generally upwards, there is little tendency for air to enter the volume swept by the impeller, thus ensuring that the impeller performs its primary function of maintaining the particles in suspension.

Since the shear forces which produce the bubbles are lower than they are in the conventional cell in which air is introduced into the impeller zone with a consequent drop in mixing efficiency, the air bubbles produced are larger and thus better suited to the flotation of particles of a size for which the cell is intended.

The circular overflow weir formed by the top of the tank 10 maximises the potential length of the weir.

EXPERIMENTAL RESULTS

Thus far tests on a prototype cell have been restricted to sizes up to 20 l. However, gold and other valuable constituents of a Witwatersrand ore have been floated successfully from 2.5 mm material over pulp densities ranging from 15 to 55% solids by mass without sanding out taking place. Varying the pulp density has been found to have only a very slight effect on air demand, power requirements and rate of flotation.

EXAMPLE

As an example of the use of the cell, gold and uranium were floated from a material grading 100%-2.36 mm 50%-150 microns in three different types of cell. The conditions of flotation were the same in each case, namely 35% solids, 9 minutes batch flotation, and 100 g of potassium amyl xanthate and 50 g of AF 65 frother added per ton of solids, the additions being made in the ratios 5:3:2 at the start, after 3 minutes and after 6 minutes of flotation respectively. The three cells were a laboratory Fagergren machine normally of 5 l capacity, but reduced to 1.7 l for the purposes of the test, operated at a power density equivalent to 35 kW/m$^3$; a 20 l cell to the design described herein, operated at a power density equivalent to 10 kW/m$^3$ exclusive of the power required for compressing air (30 l/min at a pressure of 25 kPa); and a 170 l Fagergren cell operated at a power density equivalent to 15 kW/m$^3$. The 170 l cell required manual stirring to prevent sands building up to the point where the impeller stalled. The results may be summarised as follows:

| Cell | 1.7 | 20l | 170l |
|---|---|---|---|
| % Solids in feed | 35 | 35 | 35 |
| Power density kW/m$^3$ | 35 | 10 | 15 |
| % of solids in feed floated | 33.1 | 34.2 | 18.5 |
| % of gold in feed floated | 82.6 | 86.2 | 42.7 |
| % of uranium in feed floated | 68.4 | 70.8 | 59.3 |

It is apparent that the novel cell suspends the coarse solids at a far lower power than conventional cells, and that it can yield at least as good a recovery of valuable minerals as in conventional cells, when the conventional cells are operated under conditions which suspend the coarse solids satisfactorily.

I claim:

1. A method of recovering coarse particles from pulp by froth flotation, comprising establishing a quantity of said pulp in a froth flotation tank, agitating said pulp by means of an agitator disposed centrally of and at a low level in said tank, baffling the pulp flow at a central location of said tank above said agitator, injecting air bubbles into the tank about the periphery of the tank inwardly toward the body of pulp in the tank at a level above the level of said baffling, collecting froth from an upper portion of said tank, and introducing pulp into the tank and withdrawing from the tank pulp from which coarse particles have been removed, at levels no higher than the level of said agitator.

2. A froth flotation cell comprising a tank, a driven impeller disposed centrally of and at a low level in the tank, a cover above the impeller to minimize entry of fluid from above, a series of injection points for compressed air about the periphery of the tank directed toward the interior of the tank and higher than the level of the cover, and an inlet to the tank and an outlet from the tank disposed at levels no higher than the impeller and disposed on opposite sides of the tank.

3. A froth flotation cell comprising a tank, a driven impeller disposed centrally of and at a low level in the tank, a cover above the impeller to minimize entry of fluid from above, a series of injection points for compressed air about the periphery of the tank directed toward the interior of the tank and higher than the level of the cover, the tank being cylindrical about a vertical axis, and means to withdraw froth from around the entire perimeter of the top of the tank.

4. A froth flotation cell comprising a tank, a driven impeller disposed centrally of and at a low level in the tank, a cover above the impeller to minimize entry of fluid from above, a series of injection points for compressed air about the periphery of the tank directed toward the interior of the tank and higher than the level of the cover, the tank being cylindrical about a vertical axis, and a series of radially extending baffles projecting inwardly from the periphery of the tank.

5. A cell as claimed in claim 4, in which the upper parts of the baffles are inclined to the vertical at an angle of 10 to 45 degrees, the direction of inclination being so chosen that, when viewed from above, these inclined sections of the baffles spiral downwardly in the same direction as the direction of rotation of the impeller.

* * * * *